US010612453B2

(12) United States Patent
Bruemmer

(10) Patent No.: US 10,612,453 B2
(45) Date of Patent: Apr. 7, 2020

(54) COOLING CIRCUIT

(71) Applicant: MAHLE International GmbH, Stuttgart (DE)

(72) Inventor: Richard Bruemmer, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 173 days.

(21) Appl. No.: 15/336,049

(22) Filed: Oct. 27, 2016

(65) Prior Publication Data

US 2017/0044969 A1 Feb. 16, 2017

Related U.S. Application Data

(63) Continuation of application No. PCT/EP2015/059094, filed on Apr. 27, 2015.

(30) Foreign Application Priority Data

Apr. 28, 2014 (DE) ..... 10 2014 207 978

(51) Int. Cl.
*F01P 7/16* (2006.01)
*F01P 7/14* (2006.01)

(52) U.S. Cl.
CPC ..... *F01P 7/165* (2013.01); *F01P 7/167* (2013.01); *F01P 2007/146* (2013.01)

(58) Field of Classification Search
CPC ..... F01P 7/165; F01P 7/167; F01P 2007/146
USPC ..... 123/41.1
See application file for complete search history.

(56) References Cited

U.S. PATENT DOCUMENTS

| | | | | |
|---|---|---|---|---|
| 4,370,950 | A * | 2/1983 | Furukubo | F01P 7/165 123/41.08 |
| 5,711,258 | A | 1/1998 | Saur | |
| 8,151,917 | B2 | 4/2012 | Suzuki | |
| 8,959,904 | B2 | 2/2015 | Porras et al. | |
| 9,086,001 | B2 | 7/2015 | Porras et al. | |
| 2013/0152880 | A1 | 6/2013 | Bellinger et al. | |
| 2013/0167786 | A1 | 7/2013 | Mehring et al. | |
| 2013/0306004 | A1* | 11/2013 | Katayama | F02G 5/04 123/41.1 |

FOREIGN PATENT DOCUMENTS

| | | |
|---|---|---|
| DE | 195 13 248 A1 | 10/1996 |
| DE | 196 06 202 A1 | 8/1997 |
| DE | 10 2009 023 724 A1 | 12/2010 |
| DE | 10 2013 209 429 A1 | 11/2013 |
| DE | 10 2013 209 445 A1 | 11/2013 |

(Continued)

*Primary Examiner* — Stephen K Cronin
*Assistant Examiner* — Omar Morales
(74) *Attorney, Agent, or Firm* — Muncy, Geissler, Olds & Lowe, P.C.

(57) ABSTRACT

A cooling circuit for controlling the temperature of at least two heat sources is provided that includes a heat exchanger for cooling a coolant, at least one thermostat, a first cooling branch, and a second cooling branch. The first heat source and the heat exchanger are arranged in the first cooling branch, and the second heat source is arranged in the second cooling branch. The thermostat has a mixing chamber through which the coolant can flow. The mixing chamber is fluidically connected to a coolant outlet of the heat exchanger and to a coolant outlet of the second heat source.

17 Claims, 5 Drawing Sheets

(56) References Cited

FOREIGN PATENT DOCUMENTS

| | | | | | |
|---|---|---|---|---|---|
| DE | 10 2014 204 257 | A1 | | 9/2015 | |
| DE | 102014204257 | A1 | * | 9/2015 | ..... F01P 7/165 |
| EP | 1 942 038 | A1 | | 7/2008 | |
| FR | 2 934 319 | A1 | | 1/2010 | |
| JP | 2011-169 191 | A | | 9/2011 | |

* cited by examiner

COOLING CIRCUIT

This nonprovisional application is a continuation of International Application No. PCT/EP2015/059094, which was filed on Apr. 27, 2015, and which claims priority to German Patent Application No. 10 2014 207 978.0, which was filed in Germany on Apr. 28, 2014, and which are both herein incorporated by reference.

BACKGROUND OF THE INVENTION

Field of the Invention

The invention relates to a cooling circuit for the temperature control of at least two heat sources, in particular having a heat exchanger for cooling a coolant, with at least one thermostat, with a first cooling branch and a second cooling branch, wherein in the first cooling branch, the first heat source and the heat exchanger are arranged, and the second heat source is arranged in the second cooling branch, wherein the thermostat comprises a mixing chamber which is flowed through by the coolant.

Description of the Background Art

In motor vehicles, cooling circuits are used to carry away waste heat and to maintain the individual components at an optimum operating temperature level. Waste heat is generated, for example, by the combustion engine or the power electronics used in hybrid vehicles and electric vehicles.

To continue to use the waste heat advantageously, systems are known which specifically use the waste heat of the exhaust system for generating electrical or mechanical power. These so-called waste heat recovery systems also require cooling to keep them within an optimum temperature window for operation.

The optimum temperature level in the cooling circuit for cooling the secondary heat sources, which are defined as all heat sources other than the internal combustion engine, is usually below the optimum temperature level in the cooling circuit for cooling the primary heat source, which is configured to be the combustion engine.

Advantageously, therefore, a cooling circuit is used which makes it possible to provide different temperature levels for different heat sources.

For this purpose, solutions are known in the prior art which provide for a separate additional cooling circuit, which is operated at a different temperature level than the cooling circuit for the internal combustion engine. Solutions are also known which have a plurality of branches, which can be flowed through by coolant at different temperatures.

US 2013/0152880 A1 discloses a thermostat housing which allows for an optimized coolant flow. The thermostat housing has a coolant intake and a coolant outlet and inside, further comprises two thermostats. The at least two thermostats have staggered opening temperatures. The first thermostat controls the flow of coolant through the thermostat housing when the temperature of the coolant is within a temperature window compatible with the opening temperature of the first thermostat.

Moreover, JP 2011-169191 A discloses a system for carrying away the heat from an internal combustion engine which has sufficient heat dissipation properties to dissipate the heat created from the combustion engine, said heat being produced by a high load of the engine.

A disadvantage of the solutions in the prior art is in particular, that sufficient removal of the heat is not given when multiple heat sources are integrated in the cooling circuit. Moreover, the temperature stability of the individual heat sources by previously known controllers in the cooling circuits is not sufficiently provided.

For solutions with multiple branches, it is particularly disadvantageous that a high construction outlay must be pursued to ensure sufficient cooling for the primary heat source and the secondary heat sources at any time during operation. Moreover, the heat loss of such solutions is high, thereby decreasing the efficiency of the entire system. The merging of the individual branches is also problematic because, depending on the supply location, disadvantages in terms of temperature control of the individual heat sources may arise.

SUMMARY OF THE INVENTION

It is therefore the object of the present invention to provide a cooling circuit for at least two heat sources, which allows for performing a targeted tempering of both heat sources, independent of one another. The cooling circuit is intended to have a structure as simple as possible, and high reliability.

An exemplary embodiment of the invention relates to a cooling circuit for the temperature control of at least two sources of heat, with a heat exchanger for cooling a coolant, with at least one thermostat, with a first cooling branch and a second cooling branch, wherein in the first cooling branch, the first heat source and the heat exchanger are arranged, and in the second cooling branch, the second heat source is arranged, wherein the thermostat has a mixing chamber which can be flowed through by the coolant, wherein the mixing chamber is fluidically connected to a coolant outlet of the heat exchanger and to a coolant outlet of the second heat source.

With a fluidic connection of the mixing chamber of the first thermostat to the coolant outlet of the heat exchanger and to a coolant outlet of the second heat source, it is ensured that in the mixing chamber of the first thermostat, a very accurate control of the temperature level of the coolant can be achieved. Thereby, the temperature of the coolant, which is supplied in particular to the first heat source, which is regularly configured to be an internal combustion engine, can be set very accurately, whereby cooling of the first heat source can be improved.

It is also advantageous if a second thermostat is provided, which is disposed upstream of the first thermostat in the flow direction of the coolant, flowing through the second heat source, wherein the mixing chamber of the first thermostat is fluidically connected to a coolant outlet of the second thermostat.

A second thermostat is particularly advantageous in order to allow for a temperature control in the second cooling branch that is decoupled from the temperature level of the coolant in the first cooling branch. This ensures that the first heat source and the second heat source can be supplied with cooling agents of different temperature levels. In particular, the intake temperature and/or the outlet temperature of the second heat source can be controlled by an advantageous circuit configuration of the two thermostats.

In addition, it may be advantageous when the coolant can flow from the second thermostat to the first thermostat, independent of the control state of the first thermostat.

This is particularly advantageous since it can be ensured that flow through the heat exchanger is also enabled when the main thermostat is closed. This is particularly the case when the coolant is transferred directly from the second thermostat into the mixing chamber of the first thermostat and can thus flow through the first thermostat, independent of the position of the valve body therein.

It may also be useful if a mixture of the coolant from the heat exchanger and/or of the coolant from the second thermostat, and/or of the coolant from a bypass path which bypasses the heat exchanger, can be generated within the first thermostat by adjusting a valve body.

Through the fluidic connection of the mixing chamber with the different areas of the cooling circuit, an advantageous temperature control of the coolant can be achieved. By adjusting the valve body, the inflow of the coolant from the different areas to the mixing chamber can be advantageously controlled, so that an advantageous temperature control of the coolant mixture is possible.

Furthermore, it may be particularly advantageous when the first thermostat comprises an expansion element by which the valve body of the first thermostat is adjustable, wherein a coolant mixture of the coolant from the heat exchanger and/or the coolant from the second thermostat and/or the coolant from the bypass branch act on the expansion element. This is especially advantageous for allowing exact control of the intake temperature of the coolant at the first heat source, downstream of the first thermostat.

Also, the first thermostat and the second thermostat can be integrally connected to each other. To this end, the two thermostats can be included, for example, in a common housing, whereby a compact unit can be created which only has a small space requirement and can be easily mounted. Alternatively, the thermostats arranged in separate housings can be attached to each other in an advantageous embodiment, in order to create a compact unit.

An embodiment provides that the temperature level of the coolant is lower at the second heat source than the temperature level of the coolant at the first heat source. This is generally due to the fact that the first heat source is regularly configured to be the combustion engine, while the second heat source is regularly designed as power electronics that are to be cooled. Therefore, the temperatures that occur there are often below the temperature levels of the engine. Preferably, the temperature level of the heat sources to be cooled is so different that it is necessary to branch off the cooling circuit into different cooling branches. In further alternative embodiments, further heat sources may also be provided in advantageous embodiments, each of which has further, different temperature levels.

It is also advantageous if the passage of the coolant from the second thermostat to the first thermostat can be prevented by adjusting a valve body in the second thermostat. Due to the possibility of preventing the passage of the coolant to the first thermostat, a circulating of the coolant through the second heat source can be achieved. By closing the coolant passage, the coolant remains in the second thermostat and is again supplied to the second heat source. This allows the coolant to circulate until, for example, it reaches a certain minimum temperature, before it ultimately flows into the first thermostat.

Furthermore, it is expedient if the second thermostat is arranged upstream of a coolant intake of the second heat source, in the direction of flow of the second heat source, or the second thermostat is disposed downstream of a coolant outlet of the second heat source, in the direction of flow of the second heat source. Due to the different arrangement of the second thermostat, the coolant circulation can be influenced. For example, a circulating of the coolant through a bypass between the second thermostat and the second heat source can be achieved, whereby a heating of the coolant by the second heat source can be achieved.

In an embodiment of the invention, it can be provided that the overflow of the coolant from the second thermostat into the first thermostat can be released if the coolant exceeds a minimum temperature within the second cooling branch. By releasing the passage of coolant from the second thermostat into the first thermostat when achieving a certain minimum temperature, it can be ensured that the coolant which comes from the second source of heat has a certain minimum temperature. This can be advantageous in particular for the temperature control of the coolant in the mixing chamber of the first thermostat.

Furthermore, the second thermostat can be located directly adjacent to the second heat source, separate from the first thermostat. A separate arrangement of the thermostats is particularly advantageous when the second heat source is arranged spatially far away from the first thermostat. The long coolant lines may otherwise cause a cooling of the coolant between the second heat source and the second thermostat. This may adversely affect the temperature control of the coolant in the mixing chamber of the first thermostat.

It is also advantageous if a channel-like region is disposed downstream of the heat exchanger in the flow direction of the coolant, wherein the coolant can be distributed to the first thermostat and the second thermostat by the channel-like region. With a channel-like region which is arranged in or on the housing of the thermostats, a distribution of the coolant to the two thermostats can be achieved. This is particularly advantageous since overall, it allows for a very compact design of the thermostats to be obtained.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

In the following FIGS. 1 to 10, respective schematic views of different cooling circuits are shown, substantially having at least one heat source, one heat exchanger for cooling a coolant and at least one thermostat for regulating the coolant flow within the cooling circuit. The individual embodiments are described in detail using the following figures.

Figure 1:
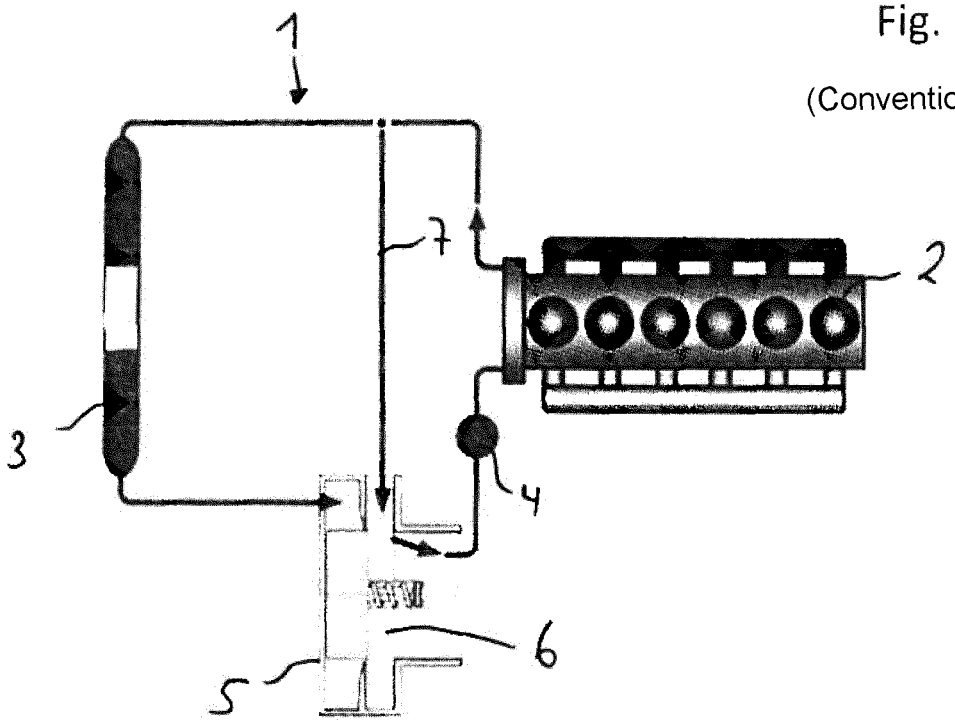
Fig. 1 (Conventional Art)
FIG. 1 is a schematic view of a cooling circuit for an internal combustion engine as is known in the conventional art.

FIG. 1 shows the schematic view of a cooling circuit 1, which corresponds to a conventional cooling circuit. In the cooling circuit 1, a heat source 2 is disposed which is configured to be an internal combustion engine. Starting from the internal combustion engine 2, a coolant can flow through the cooling circuit 1 and thereby pass through a heat exchanger 3. The coolant cooled by the heat exchanger 3 can flow into a thermostat 5, which comprises a mixing chamber 6. In addition, the cooling circuit 1 has a bypass branch 7 which allows the coolant to flow directly into the thermostat 5 by bypassing the heat exchanger 3. From the thermostat 5, the coolant flows back to the combustion engine 2 along a coolant pump 4. The cooling circuit 1 shown represents the foundation which is expanded in the following FIGS. 2 to 10.

Figure 2:
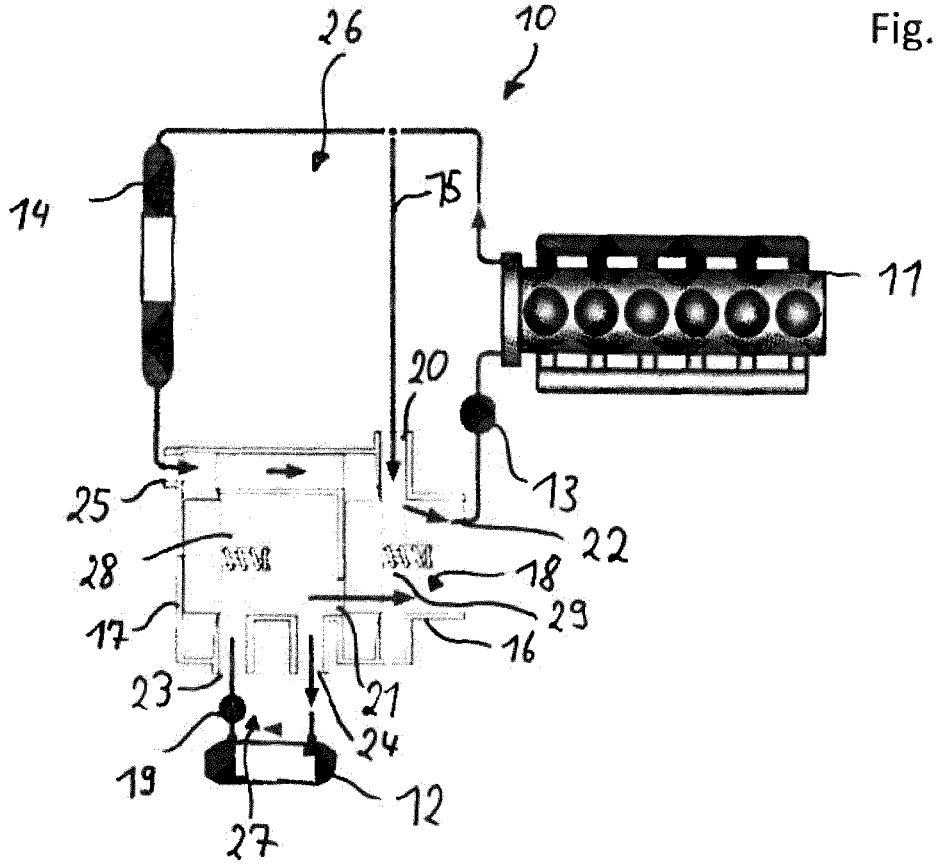
FIG. 2 is a schematic view of a cooling circuit with two cooling branches, wherein in each cooling branch, a heat source and a thermostat are arranged.

FIG. 2 shows a cooling circuit 10 having a first cooling branch 26 and a second cooling branch 27. The structure of the first cooling branch 26 shown in FIGS. 2 to 10 is largely the same, therefore, the same elements are given the same reference numerals. Only the coolant supply from the heat exchanger to the coolant pump can be different due to the different arrangement and interconnection of the thermostats.

In the cooling circuit 10, a first heat source 11 is shown, which is configured to be an internal combustion engine. From the coolant outlet of the first heat source 11, the coolant can flow either along a heat exchanger 14 or along a bypass branch 15, bypassing the heat exchanger 14. In the first cooling branch 26, a coolant pump 13 is disposed, which forwards the coolant into the first heat source 11.

In the second cooling branch 27, a second heat source 12 is disposed, and a second coolant pump 19. The second heat source 12 is preferably configured to be a condenser, which can be used for the recovery of heat energy from the exhaust system. In alternative embodiments, however, also any other source of heat can take the place of the condenser.

In the cooling circuit 10, a first thermostat 16 is arranged, and a second thermostat 17. In the first thermostat 16, a mixing chamber 18 is formed, in which the coolant, which flows through the bypass branch 15 or from the heat exchanger 14 or from the second thermostat 17, is mixed. Via a coolant outlet 22, the mixed coolant can flow back to the first heat source 11 along the coolant pump 13.

The second thermostat 17 has a valve body 28, which allows for an opening and closing of the second thermostat 17. Via a coolant outlet 24, coolant can flow from the second thermostat 17 to the second heat source 12, and along the second coolant pump 19 via a coolant intake 23 back into the first thermostat 17. By an adjustment of the valve body 28, the flow of the coolant can be controlled within the second thermostat. This can be done in particular temperature-dependent.

Between the first thermostat 16 and the second thermostat 17, a coolant passage 21 is provided, which is formed by an opening in the housings of the thermostats 16, 17. Through this coolant passage 21, the coolant can pass from the second thermostat 17 into the first thermostat 16. The coolant intake 20 of the first thermostat 16 and the inflow of coolant from the heat exchanger 14 into the thermostat 16 can be regulated by an adjustment of the valve body 29.

In the embodiment of FIG. 2, with an open second thermostat 17, the coolant can be guided from the second heat source 12 directly into the mixing chamber 18 of the first thermostat 16, whereby advantageously, the coolant heated through the second heat source 12 can be transferred into the first cooling branch 26 at any time by opening the second thermostat 17.

The mixing of the material flows from the bypass branch 15, the heat exchanger 14 and the second heat source 12 is carried out directly in the first thermostat 16, which is arranged on the intake side of the first heat source 11. In this way, the occurrence of vibrations within the coolant can be reduced or completely avoided.

The thermostats 16, 17 of FIG. 2 are each configured as sleeve valve thermostats. Generally, thermostats as those shown in FIGS. 1 to 10 can be of a known type. They serve in particular for the mixing, release and blocking of individual flow paths.

Figure 3:
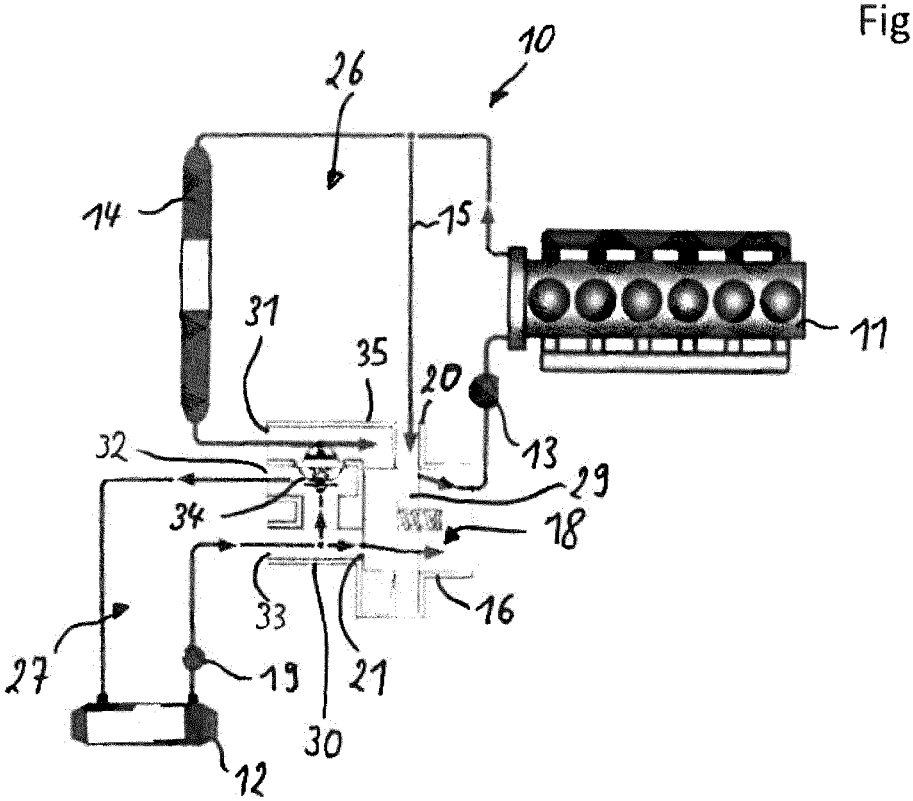
FIG. 3 is an embodiment of a cooling circuit according to FIG. 2, wherein one thermostat is designed as a sleeve valve thermostat and one thermostat as a plate thermostat.

FIG. 3 shows an embodiment of the cooling circuit 10 with a first cooling branch 26 and a second cooling branch 27. As in the previous FIG. 2 and also in the following FIGS. 4 to 10, the first heat source 11, the heat exchanger 14, the bypass branch 15 and the coolant pump 13 are disposed within the first cooling branch 26. In the second cooling branch 27, the second heat source 12 and the second coolant pump 19 are arranged. The second cooling branch 27 is acted upon by the coolant via a second thermostat 30, while the first cooling branch 26 has a first thermostat 16 as has been described above.

The second thermostat 30 in the embodiment of FIG. 3 is designed as a plate thermostat. Over a coolant intake 31, the coolant can enter a channel-like region 35 from the heat exchanger 14. There, depending on the position of the valve body, it can be introduced into the second thermostat 30 and then flow through the coolant outlet 32 to the second heat source 12 and across the coolant intake 33 back into the second thermostat 30.

From the channel-like region 35, which is disposed downstream of the coolant intake 31, the coolant flows into the first thermostat 16 described above, regardless of the position of the thermostat 30. Between the second thermostat 30 and the first thermostat 16, a coolant passage 21 is provided, which also is formed by openings in the housings of the thermostats 16, 30. In the mixing chamber 18 of the thermostat 16, again, a mixing of different coolant flows can take place.

Figure 4:
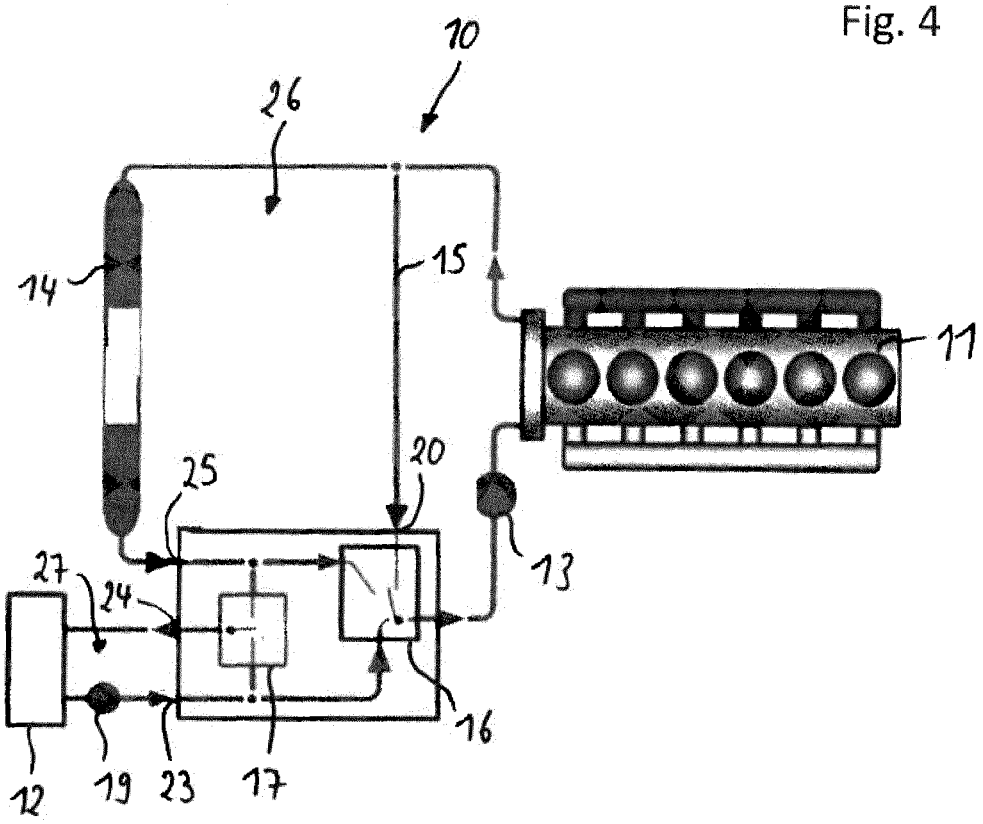
FIG. 4 is a schematic diagram of a cooling circuit shown in FIGS. 2 and 3, wherein the second thermostat is disposed on the intake side of the second heat source.

FIG. 4 shows a schematic representation of the cooling circuit 10, and in particular, that the second thermostat 17 is disposed on the input side of the second heat source 12. The coolant thus flows from the thermostat 17 along the coolant outlet 24 into the second heat source 12 and along the coolant intake 23 back into the second thermostat 17. The remaining structure of the first cooling branch 26 and the second cooling branch 27 is consistent with the previous FIGS. 2 and 3.

Figure 5:
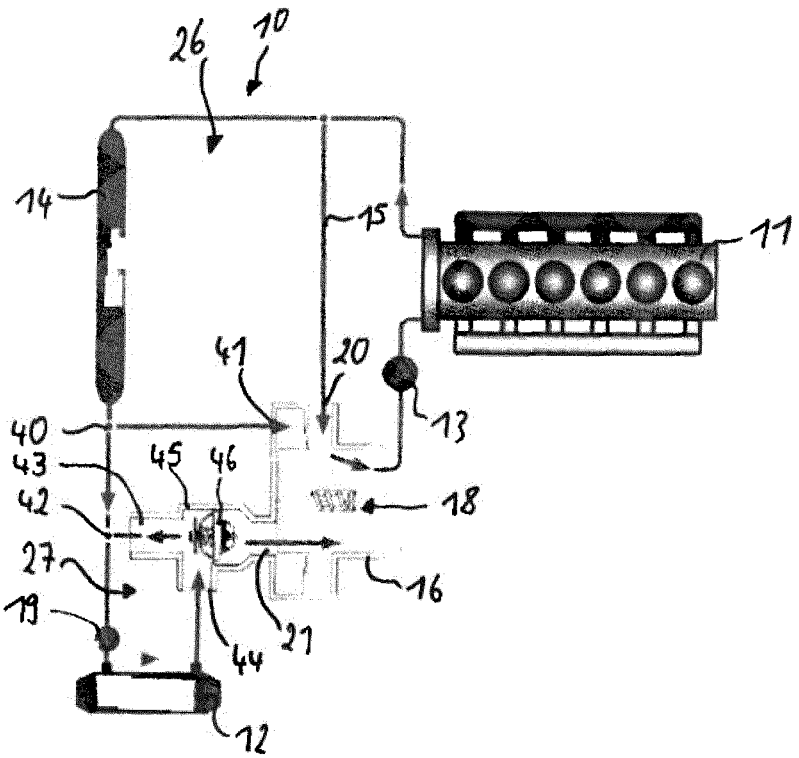
FIG. 5 is a schematic representation of a cooling circuit, wherein the coolant is diverted at the outlet of the heat exchanger to the first thermostat and to a coolant intake of the second heat source, wherein the second thermostat is disposed downstream of a coolant outlet of the second heat source.

FIG. 5 shows a further view of a cooling circuit 10, wherein the first cooling branch 26 is constructed analogously to the preceding FIGS. 2 to 4. Likewise, the first thermostat 16 is constructed similarly to FIGS. 2 to 4 and connected to the cooling circuit 10.

In contrast to the previous figures, a coolant node 40 is provided downstream of the heat exchanger 14, which allows for a branching of the coolant to the coolant intake 41 of the first thermostat 16, and further a forwarding of the coolant to the downstream coolant node 42, and finally via the coolant pump 19 to the second heat source 12. At the coolant node 42, the coolant flowing from the second thermostat 45 is continued to be supplied with further coolant, which flows through the coolant outlet 43 from the second thermostat 45.

After flowing through the second heat source 12, the coolant can flow into the second thermostat 45 via the coolant intake 44. Depending on the position of the valve body 46, the coolant is either again guided via a small bypass branch, which is formed by the coolant outlet 43 and the downstream coolant line up to the coolant node 42, to the second heat source 12, or via a coolant passage 21 to the first thermostat 16 arranged on the right.

In this manner, in particular the heating of the coolant by the second heat source 12 can be achieved up to a certain defined opening temperature of the second thermostat 45. Thus, the coolant from the second heat source 12 is supplied to the first thermostat 16 only from a certain minimum temperature.

Figure 6:
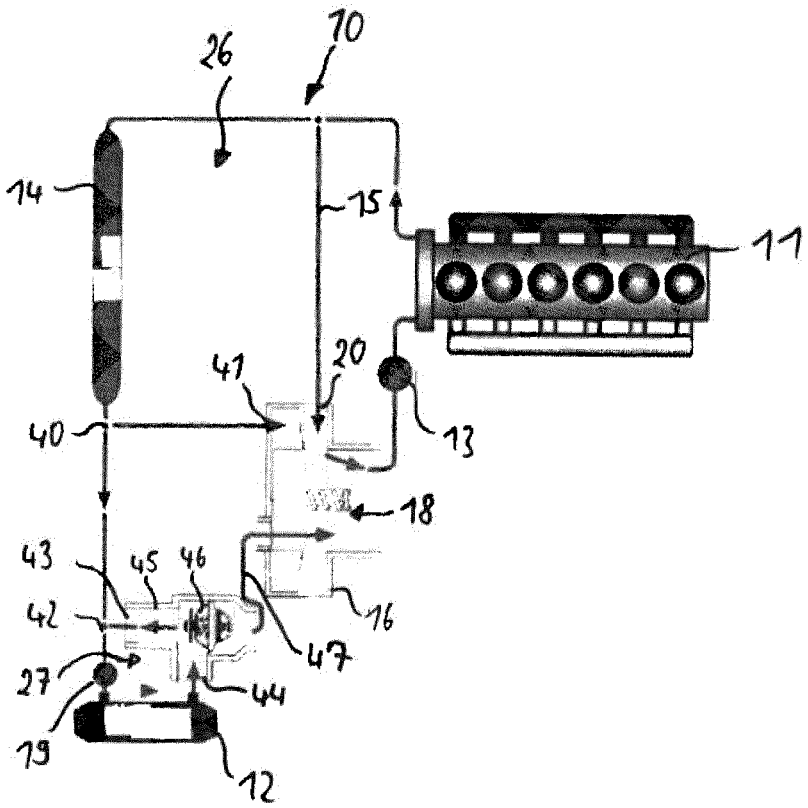
FIG. 6 is a schematic view of a cooling circuit according to FIG. 5, wherein the second thermostat is disposed separately from the first thermostat in close proximity to the second heat source to keep the flow paths between the second thermostat and the second heat source as short as possible.

FIG. 6 shows an embodiment of a cooling circuit 10, which has a structure analogous to the one in FIG. 5. In contrast to FIG. 5, the second thermostat 45 is now not designed directly in one piece with the first thermostat 16, but is arranged directly adjacent to the second heat source 12. The fluidic connection from the second thermostat 45 to the first thermostat 16 is made via an additional coolant line 47.

This configuration is particularly advantageous in order to achieve a more rapid heating of the coolant within the second heat source 12. In particular, when the second heat source 12 is positioned far from the second thermostat 45, a cooling of the coolant can occur along the coolant line between the second heat source 12 and the second thermostat 45, whereby the opening of the second thermostat 45 can be significantly delayed. By arranging the second thermostat 45 directly adjacent to the second heat source 12, the conductive paths between the second heat source 12 and the second thermostat 45 can be kept short. The coolant passage 21 formed in FIG. 5 is formed in FIG. 6 by a coolant outlet at the second thermostat 45, the coolant line 47 and a coolant intake at the first thermostat 16.

Figure 7:
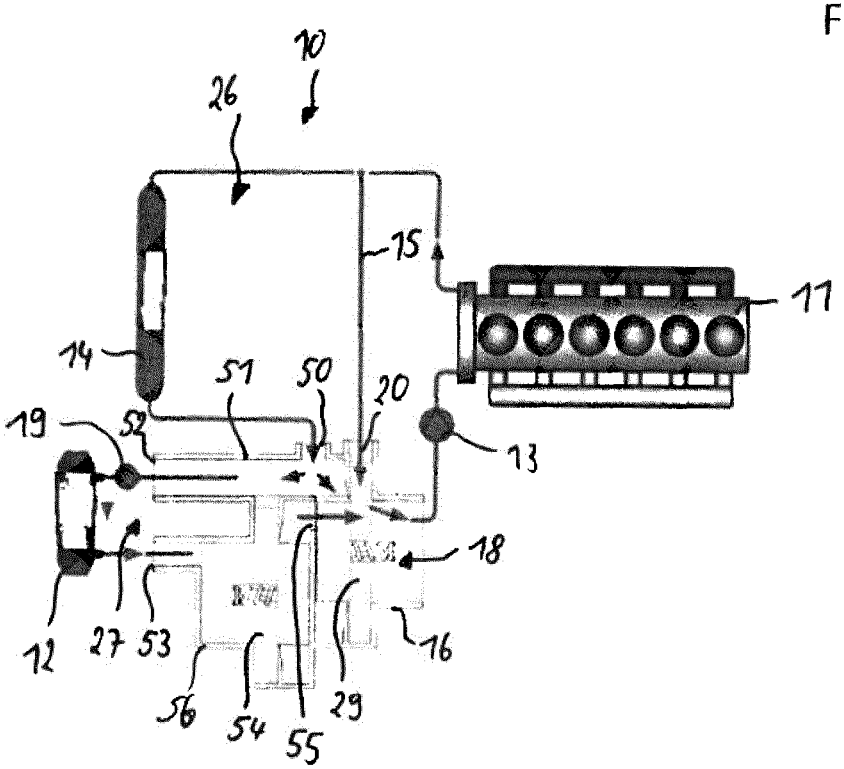
FIG. 7 is a schematic view of a cooling circuit, wherein both thermostats are designed as sleeve valve thermostats and the second thermostat is disposed downstream of the coolant outlet of the second heat source.

In the preceding FIGS. 2 to 4, the second thermostat was disposed upstream of the respective entry of the coolant into the second heat source 12. In FIG. 7, the second thermostat 56 as well as the second thermostat 45 in FIGS. 5 and 6, are located downstream of the second heat source in the flow direction.

Starting from the heat exchanger 14, the coolant can flow through a coolant intake 50 into a channel-like region 51. In this channel-like region 51, the coolant is diverted both to the first thermostat 16 as well as to the second heat source 12 via a coolant outlet 52. The coolant pump 19 is located between the channel-like region 51 and the second heat source 12. After flowing through the second heat source 12, the coolant enters the second thermostat 56 through a coolant intake 53. The second thermostat 56 has a valve body 54 which can regulate the flow of coolant, in particular to a coolant passage 55 between the first thermostat 16 and the second thermostat 56. After the passage of the coolant 55, as already described, a mixing of the coolant components of the bypass branch 15, the heat exchanger 14 and the second thermostat 56 can take place in the mixing chamber 18, wherein the mixed coolant can then be transported via the coolant pump 13 to the first heat source 11.

For the outlet-side arrangement of the second thermostat 56, as indicated above in FIG. 6, a separate embodiment of the two thermostats 16 and 56 can be useful in particular to avoid heat loss at the coolant line between the second thermostat 56 and the second heat source 12.

Figure 8:
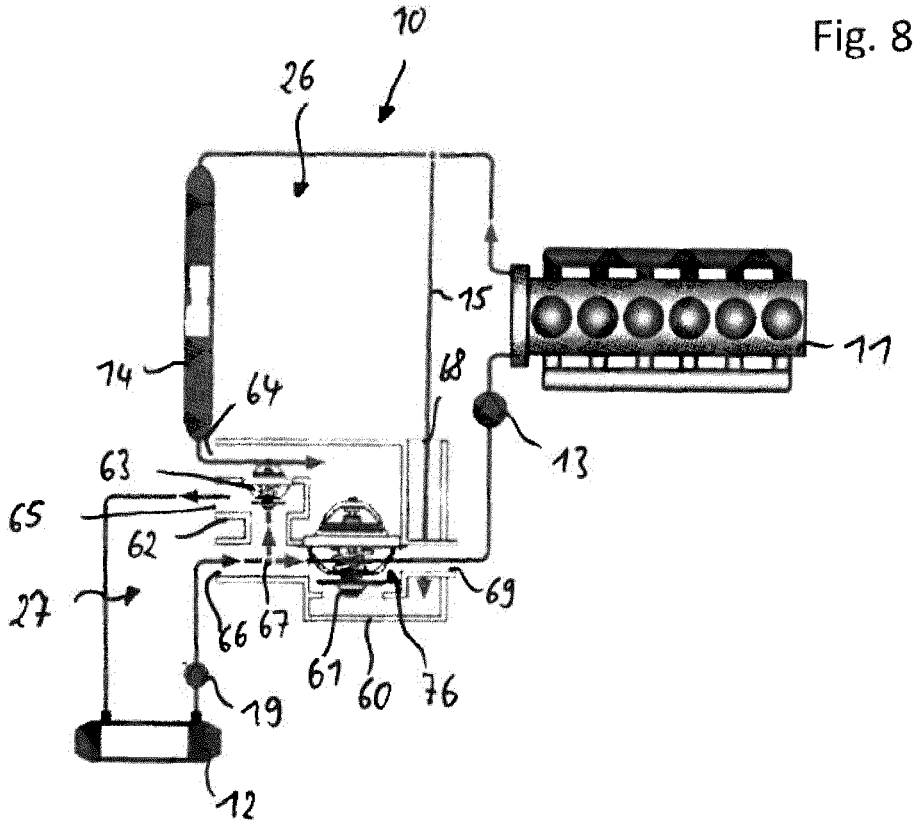
FIG. 8 is an embodiment of a cooling circuit according to FIG. 7, wherein the two thermostats are constructed as plate thermostats.

FIG. 8 shows an embodiment of the cooling circuit 10, wherein the first thermostat 60 and the second thermostat 62 are each formed by plate thermostats. The coolant enters through a coolant intake 64 into an area that allows for distribution into the two thermostats 60, 62, depending on the position of the valve body 63 of the second thermostat 62 and of the valve body 61 of the first thermostat 60. From the second thermostat 62, the coolant flows through a coolant outlet 65 into the second heat source 12 and through the coolant pump 19 via the coolant intake 66, back into the second thermostat 62. There, at a coolant node 67, the coolant can be forwarded either to the first thermostat 60, or back in the direction of the valve body 63 and to the coolant outlet 65.

The first thermostat 60 has a coolant intake 68, via which the coolant can flow in from the bypass branch 15. The coolant flowing through the coolant intake 64, the coolant intake 68 and from the second thermostat 62, may be mixed together in a mixing chamber 76 in the region of the valve body 61 and finally flow through the coolant outlet 69 and the coolant pump 13 to the first heat source 11.

In the embodiment of FIG. 8, the first thermostat 60 and the second thermostat 62 are disposed directly adjacent to each other and preferably accommodated in a common housing element. In the illustration of FIG. 8, the coolant outlet 69 crosses the coolant intake 68, which can be done, for example, with a stub through the channel of the coolant intake 68 or with an arrangement of the coolant outlet 69 and the coolant intake 68 that are offset in depth to one another. Also in the embodiment of FIG. 8, the coolant flowing out of the second heat source 12 can be supplied directly to the mixing chamber 76 in the area of the valve body 61 of the first thermostat 60.

Figure 9:
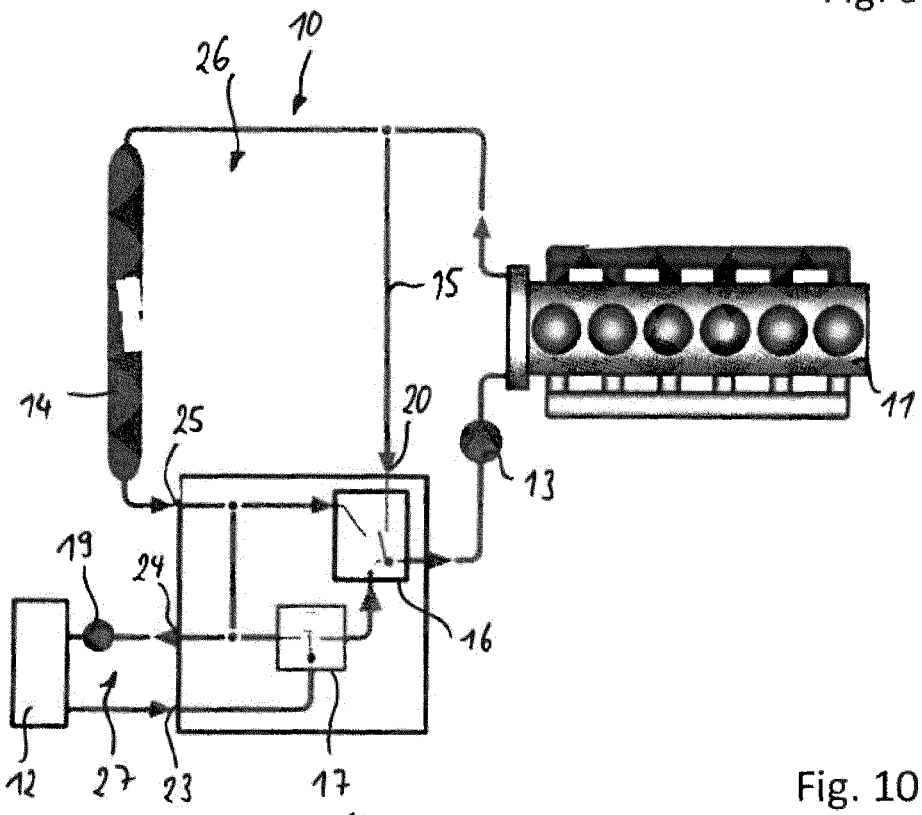
FIG. 9 is a schematic diagram of a cooling circuit, wherein the second thermostat of the second heat source is disposed downstream of the outlet side.

FIG. 9 shows a schematic view of a cooling circuit 10, wherein in the embodiment of FIG. 9, in contrast, for example, to FIG. 4, the second thermostat 17 is disposed on the outlet side of the second heat source 12. The remaining structure is consistent with the representation of FIG. 4.

With the outlet-side arrangement of the second thermostat 17, an arrangement can be achieved as is shown, for example, in FIG. 7. The coolant can thereby repeatedly flow in a small cycle through the second coolant pump 19 and the second heat source 12 until it reaches an opening temperature of the second thermostat 17, before a transfer into the first thermostat 16 is achieved by opening the second thermostat 17. The supply of coolant is therefore carried out by an additional line, which directly leads from the outlet of the heat exchanger 14 to the coolant intake of the second heat source 12 or to the coolant pump 19.

Figure 10:
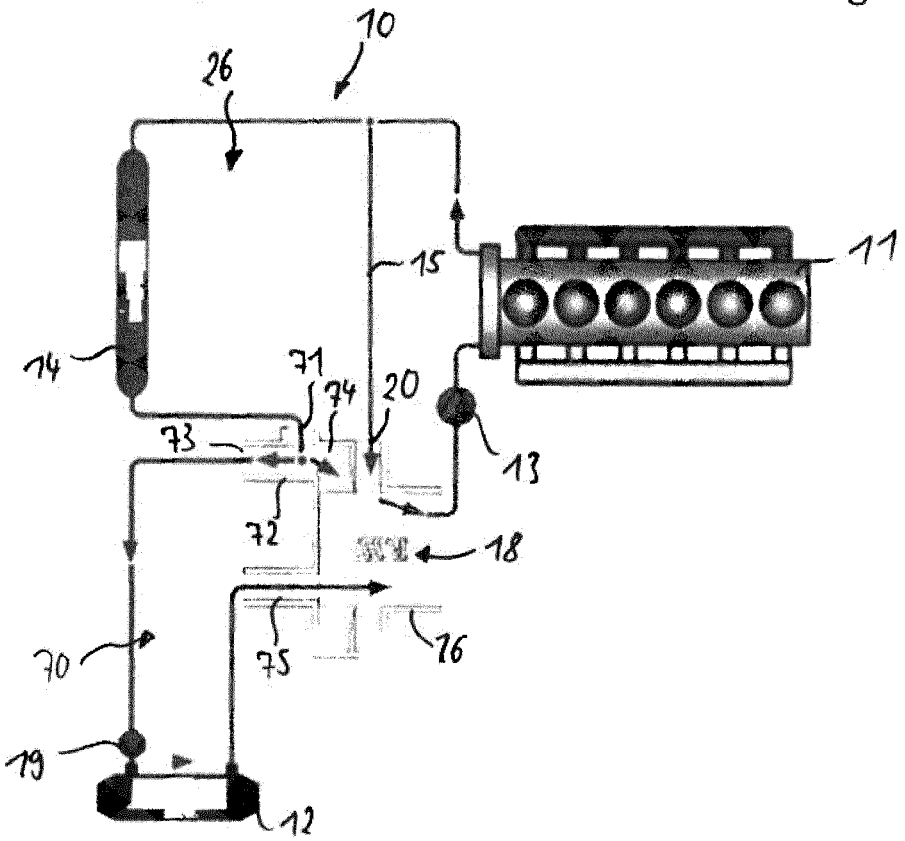
FIG. 10 is a schematic view of an alternative embodiment of a cooling circuit, wherein only one thermostat is provided, which regulates the coolant flow through both heat sources.

FIG. 10 shows an embodiment of a cooling circuit 10 having a first heat source 11 and a second heat source 12, wherein no additional second thermostat is provided for regulating the flow of coolant to the second heat source 12. This embodiment is particularly advantageous in order to achieve simplification of the cooling circuit 10 when no active temperature control for the second heat source 12 is needed. The coolant may flow through a coolant intake 71, which is disposed downstream of the heat exchanger 14 in the direction of flow, into a channel-like region 72 in which a distribution of the coolant takes place to the coolant intake 74 in the first thermostat 16, and a further distribution to the coolant outlet 73, which leads to the coolant pump 19 and to the second heat source 12. After flowing through the second heat source 12, the coolant can be supplied through a coolant intake 75 directly into the mixing chamber 18 of the first thermostat 16. The first thermostat 16 is constructed similarly to that in FIGS. 2 and 3. The coolant from the second heat source 12 can thus be discharged directly into the mixing chamber 18 of the first thermostat 16, independent of a position of the thermostat. In this way, the dissipation of heat from the second heat source 12 is always ensured. Also, the temperature stability at the intake of the first heat source 11 is ensured.

In alternative embodiments, in particular in place of the indicated sleeve valve thermostats or plate thermostats, also electrically or mechanically operated valves may be used. The basic design of the cooling circuit and in particular of the two cooling branches, remains unchanged. Furthermore, it may be provided in alternative embodiments that in particular the bypass of the second heat source, which makes it possible to circulate the coolant until reaching an opening temperature of the second thermostat, is formed by a coolant outlet from the first thermostat or by the bypass branch of the first cooling branch.

In FIGS. 2 to 10, it is assumed that the temperature level of the first heat source 11 is always higher than that of the second heat source 12. The arrangement and connection of the individual elements shown in FIGS. 2 to 10 may also be beneficial in case the temperature of the second heat source 12 is higher than the temperature level of the first heat source 11. In alternative embodiments, the thermostats shown in FIGS. 2 to 9 can also be arranged on the coolant outlet side of the first heat source 11. This is particularly useful when the temperature level of the second heat source 12 is greater than the temperature level of the first heat source 11.

The cooling circuits 10 of FIGS. 2 to 10, in particular, can also be used for applications with more than two heat sources. In the case of more than two heat sources, the use of more than two thermostats can also be advantageous. This is particularly advantageous when the plurality of the heat sources is each operated at different temperature levels. Generally, for each intended temperature level, a thermostat can be provided to achieve adequate control of the coolant flow.

In spite of the series connection of the heat sources, by connecting the two thermostats to a double thermostat, thermostatic control of the heat source at the lower temperature level is made possible, regardless of the state of the first thermostat which is associated with the heat source having the higher temperature level. Even if the first thermostat is closed, a dissipation of heat from the second heat source which has the lower temperature level is always ensured. The serial connection of the heat sources in particular allows for best possible cooling at the lower temperature level.

The embodiments of FIGS. 2 to 10 serve to illustrate the inventive idea. They are not restrictive, in particular with regard to the arrangement of the individual elements as well as to the design of the individual elements, such as the heat sources and thermostats.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cooling circuit for the temperature control of at least two heat sources, the cooling circuit comprising:

a heat exchanger for cooling a coolant; and a first thermostat with a first cooling branch and with a second cooling branch;

a first heat source and a second heat source; and a second thermostat arranged upstream of the first thermostat in a flow direction of the coolant which flows through the second heat source, wherein in the first cooling branch, the first heat source, a bypass branch that bypasses the heat exchanger and the heat exchanger are arranged, and in the second cooling branch, the second heat source is arranged, wherein the first thermostat has a mixing chamber that is adapted to be flowed through by the coolant, wherein the mixing chamber is fluidically connected to a coolant outlet of the heat exchanger and to a coolant outlet of the second heat source, wherein coolant flowing through the bypass branch flows directly into the first thermostat, and wherein the second thermostat and the second heat source are arranged such that a portion of the coolant flows directly from the second thermostat to the second heat source, then through the second heat source and then from the second heat source back to the second thermostat before the portion of the coolant flows from the second thermostat to the first thermostat or a portion of the coolant flows directly from the second thermostat to a pump and then directly from the pump to the second heat source, then through the second heat source and then from the second heat source back to the second thermostat before the portion of the coolant flows from the second thermostat to the first thermostat.

2. The cooling circuit according to claim 1, wherein the mixing chamber of the first thermostat is fluidically connected with a coolant outlet of the second thermostat.

3. The cooling circuit according to claim 1, wherein, independent of a control state of the first thermostat, the coolant passes from the second thermostat into the first thermostat.

4. The cooling circuit according to claim 1, wherein, within the first thermostat, a mixing of the coolant from the heat exchanger and/or of the coolant from the second thermostat and/or of the coolant from the bypass branch, which bypasses the heat exchanger, is generated by an adjustment of a valve body.

5. The cooling circuit according to claim 4, wherein the first thermostat comprises an expansion element by which the valve body of the first thermostat is adjustable, wherein a coolant mixture of the coolant from the heat exchanger and/or of the coolant from the second thermostat and/or of the coolant from the bypass branch acts on the expansion element.

6. The cooling circuit according to claim 1, wherein the first thermostat and the second thermostat are integrally connected to each other.

7. The cooling circuit according to claim 1, wherein a temperature level of the coolant is lower at the second heat source than a temperature level of the coolant at the first heat source.

8. The cooling circuit according to claim 1, wherein the passage of the coolant from the second thermostat into the first thermostat is prevented by an adjustment of a valve body in the second thermostat.

9. The cooling circuit according to claim 1, wherein the second thermostat is arranged upstream of a coolant intake of the second heat source in a direction of flow of the second heat source or wherein the second thermostat is arranged downstream of a coolant outlet of the second heat source in the direction of flow of the second heat source.

10. The cooling circuit according to claim 1, wherein the passage of the coolant from the second thermostat into the first thermostat is releasable by the coolant exceeding a minimum temperature in the second cooling branch.

11. The cooling circuit according to claim 1, wherein the second thermostat is arranged separated from the first thermostat and is directly adjacent to the second heat source.

12. The cooling circuit according to claim 1, wherein a channel-like region is arrange downstream of the heat exchanger in a direction of flow of the coolant, and wherein, through the channel-like region, the coolant is diverted into the first thermostat and into the second thermostat.

13. The cooling circuit according to claim 1, wherein the second cooling branch is directly connected to at least an inlet or and outlet of the second thermostat.

14. The cooling circuit according to claim 1, wherein all coolant entering the first heat source from the second thermostat flows from the second thermostat, through the first thermostat and then into the first heat source.

15. The cooling circuit according to claim 1, wherein the first heat source is an internal combustion engine.

16. The cooling circuit according to claim 1, wherein there is solely a one-way direction coolant flow connection between the first thermostat and the second thermostat, such that the coolant flows from the second thermostat to the first thermostat.

17. The cooling circuit according to claim 1, wherein a conduit extending from the heat exchanger branches, such that a portion of the conduit leads directly to the first thermostat and a portion of the conduit leads directly to either the second thermostat or the second heat source.

* * * * *